US006832923B2

(12) United States Patent
Sasame et al.

(10) Patent No.: US 6,832,923 B2
(45) Date of Patent: Dec. 21, 2004

(54) ELECTRICAL CONNECTOR WITH SHUTTER AND ELECTRICAL CONNECTOR ASSEMBLY

(75) Inventors: Naotaka Sasame, Tokyo (JP); Shinichi Hashimoto, Kanagawa (JP)

(73) Assignee: Tyco Electronics. AMP, K.K., Kanagawa (JP)

( * ) Notice: Subject to any disclaimer, the term of this patent is extended or adjusted under 35 U.S.C. 154(b) by 51 days.

(21) Appl. No.: 10/154,541

(22) Filed: May 24, 2002

(65) Prior Publication Data

US 2002/0177336 A1 Nov. 28, 2002

(30) Foreign Application Priority Data

May 25, 2001 (JP) ..... 2001-156708

(51) Int. Cl.[7] ..... H01R 13/44
(52) U.S. Cl. ..... 439/137
(58) Field of Search ..... 439/137, 138, 439/139, 140, 181; 361/220

(56) References Cited

U.S. PATENT DOCUMENTS 4,149,027 A * 4/1979 Asher et al. ..... 463/44
4,176,897 A * 12/1979 Cameron ..... 439/138
4,824,377 A 4/1989 De Burro ..... 439/186
4,847,711 A * 7/1989 Inoue ..... 360/96.5
5,167,516 A * 12/1992 Tan et al. ..... 439/141

FOREIGN PATENT DOCUMENTS

JP 07-1995-45328 2/1995

OTHER PUBLICATIONS

IBM (Technical Disclosure Bulletin) vol. 39 No. 08 Aug, 1996.*

* cited by examiner

*Primary Examiner*—Tulsidas Patel
*Assistant Examiner*—Phuong Dinh
(74) *Attorney, Agent, or Firm*—Barley Snyder

(57) ABSTRACT

An electrical connector assembly comprising a first connector and a second connector. The first connector has a mating portion and a shutter member that is mounted substantially adjacent to the mating portion. A first conductor is provided on the shutter member and a cam engagement member drives the shutter member between an open and a closed position. The second connector has an actuator with a cam. A second conductor is provided on the cam and contacts the first conductor to prevent electrostatic discharge when the cam engages the cam engagement member to drive the shutter member into an open position.

13 Claims, 9 Drawing Sheets

46
6a
50a
48
52
53
55
56
54
49
60
E
D
50
70

ELECTRICAL CONNECTOR WITH SHUTTER AND ELECTRICAL CONNECTOR ASSEMBLY

BACKGROUND OF THE INVENTION

The invention relates to electrical connector assemblies and, more particular, to an electrical connector that prevents electrostatic discharge and has a shutter for preventing foreign matter from damaging electronic parts.

DESCRIPTION OF THE PRIOR ART

Electrical connectors are commonly used in devices, such as personal computers, for electrically connecting electronic parts mounted on circuit boards to each other. During the process of connection and before contacts arranged in an interior of each of the connectors make electrical contact with each other, electrostatic discharge (ESD) caused by static electricity can occur. Excessive voltage, generated by the ESD, can damage the electronic parts mounted on the circuit boards. Additionally, mating portions of the electrical connectors are exposed to foreign matter, such as dust and dirt, during the mating process that can interfere with the operation of the electronic parts.

A known method of reducing damage to electronic components by EDS is disclosed in Japanese Unexamined Patent Publication No. 2 (1990)-207469. A connector is disclosed having a mating portion with a metallic shell. A metal plate or a conductor extends in the lengthwise direction of the mating portion and is connected to the metallic shell. The metal plate or the conductor has apertures for receipt of contacts. The metal plate or the conductor creates a static electricity discharge barrier member by diverting the EDS to the barrier member before it is generated between the contacts. The barrier member serves to prevent the excessive voltage generated by the ESD from reaching the contacts by grounding the excessive voltage.

A known method of reducing damage to electronic components by foreign matter is disclosed in Japanese Unexamined Patent Publication No. 7 (1995)-45328. An electronic device, in the form of a cellular phone, has a connector positioned within the interior of a frame. The connector corresponds to an opening portion provided on the frame. The opening portion has a lid portion that pivots between an open state and a closed state. In a normal state, the lid portion is positioned in a closed state to prevent the entry of foreign matter. When the electronic device is mounted on a second connector, such as a car adapter, the second connector pivots the lid portion to an open state to engage with the connector of the electronic device. The lid portion thereby prevents foreign matter from coming into contact with the connector.

In the former connector, electronic parts are protected from excessive voltage caused by ESD and, in the latter connector, foreign matter is prevented from attaching to the connector. It is therefore desired to provide a connector that is capable of performing both of these functions. It is further desired that these functions be capable of being imparted on an existing connector.

SUMMARY OF THE INVENTION

The invention relates to an electrical connector having an insulating housing and a shutter member. The insulating housing has a mating portion with at least one contact. The shutter member is mounted on the insulating housing substantially adjacent to the mating portion and has a cam engagement member that drives the shutter member between an open and a closed position. A conductor is provided on the shutter member that contacts a second connector to prevent electrostatic discharge.

BRIEF DESCRIPTION OF THE DRAWINGS

FIG. 1 shows a shuttered connector.

FIG. 2 shows the shuttered connector of FIG. 1.

FIG. 3 shows a frame of the shuttered connector of FIG. 1.

FIG. 4 shows a lower half of a shutter member of FIG. 1A.

FIG. 5 shows a connector sub-assembly.

FIG. 6 shows sides of the connector sub-assembly.

FIG. 7 shows the conductor.

FIG. 8 shows the steps of mating engagement for the connector assembly.

FIG. 9 shows the steps of mating engagement for the connector assembly.

DETAILED DESCRIPTION OF THE PREFERRED EMBODIMENT

Figure 1A:
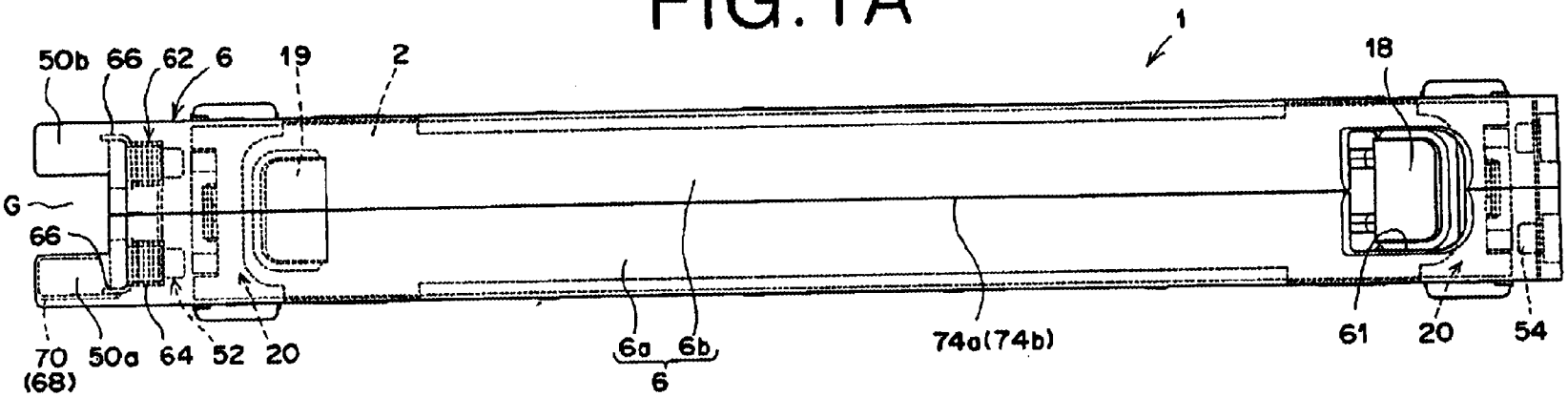
FIG. 1A is a top view.
Figure 1B:
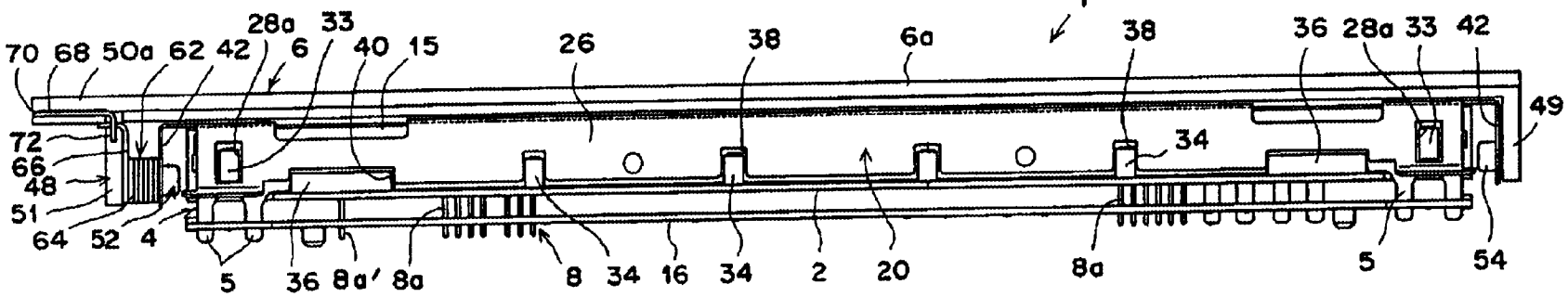
FIG. 1B is a front view.
Figure 2A:
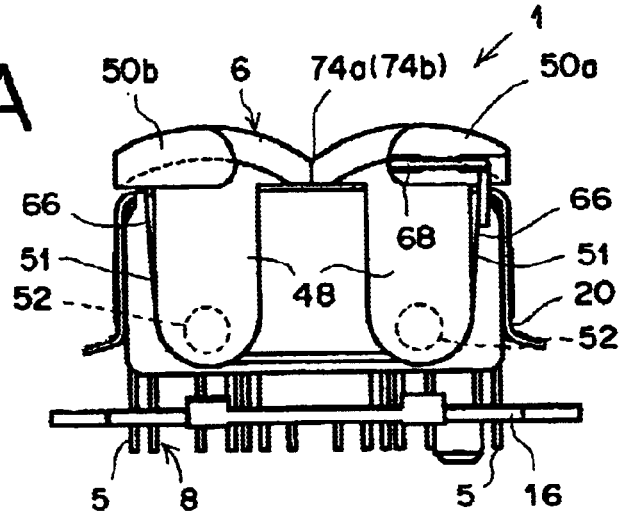
FIG. 2A is a left side view.
Figure 2B:
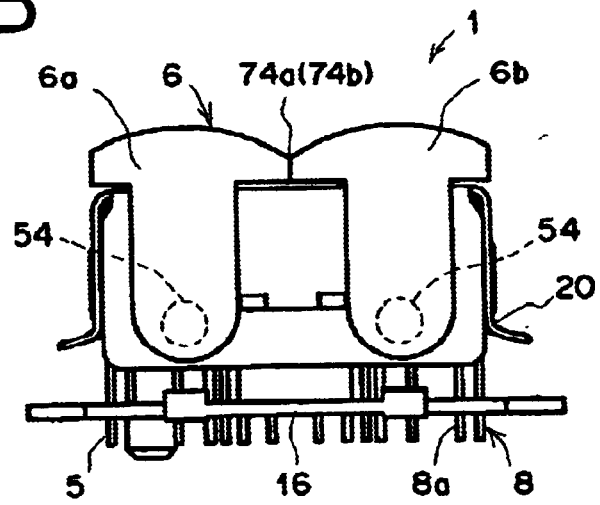
FIG. 2B is a right side view.

FIGS. 1 and 2 show a shuttered connector 1 having an insulating housing 2 and a metallic shield shell 4. The housing 2 is substantially rectangular in shape and made out of a material such as a synthetic resin. A plurality of contacts 8 extend from a bottom surface of the housing 2. The shell 4 substantially covers a periphery of the housing 2 and has a metallic frame 20 mounted on an outside of the shell 4. A shutter member 6 is rotatably mounted on the frame 20.

Figure 2C:
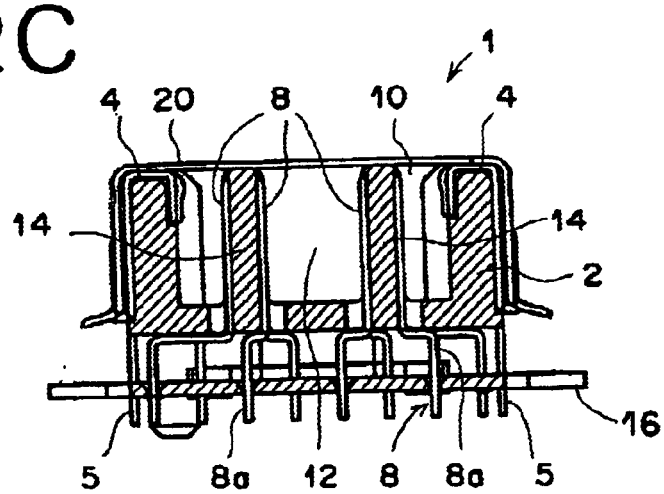
FIG. 2C is a sectional view of the main parts of the shuttered connector, excluding the shutter member.

As shown in FIG. 2C, a mating portion 10 is provided at an upper surface of the housing 2. The mating portion 10 has a mating recess portion 12 for mating with a second connector 102, shown in FIG. 5. Two ribs 14, spaced apart from each other and extending in the lengthwise direction of the housing 2, are formed within the mating recess portion 12, integrally with the housing 2. The contacts 8 are arranged in a row on both sides of each of the ribs 14. As shown in FIG. 1A, guide holes 18 and 19 are formed in the vicinity of both of the end portions along the lengthwise direction of the housing 2 of the mating portion 10 for receiving guide posts 126 of the second connector 102. As shown in FIG. 1B, rectangular protrusions 34, 36 are formed at a predetermined interval on a sidewall 15 of the housing 2.

As shown in FIGS. 1 and 2, tines 8*a* of the contacts 8 extend from a bottom surface of the housing 2. A tine plate 16 is attached to the tines 8*a* to align tips of the tines 8*a*. As most clearly shown in FIG. 2C, the shell 4 extends past the upper surface of the housing 2, to the interior of the mating recess portion 12. Grounding legs 5 extend downward from both ends of the shell 4 and are formed integrally therewith. When the connector 1 is mounted, the grounding legs 5 are inserted into a circuit board (not shown) and soldered therewith.

Figure 3A:
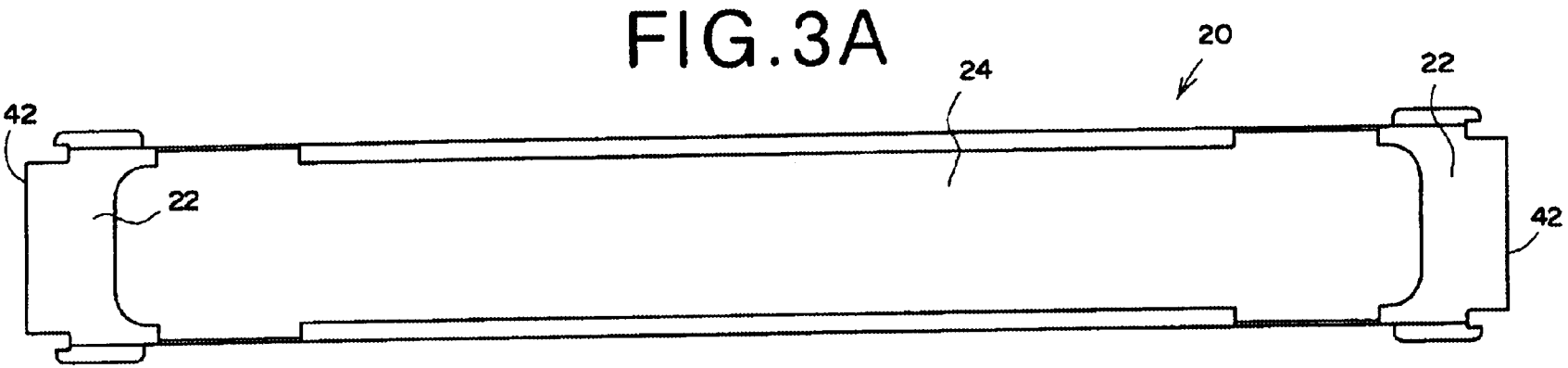
FIG. 3A is a top view.
Figure 3B:
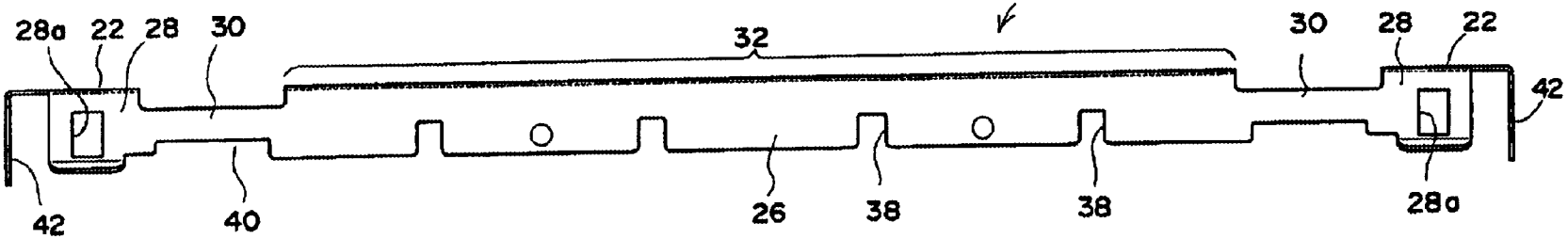
FIG. 3B is a front view.

As shown in FIG. 3, the frame 20 is mounted on the outer periphery of the shell 4 in a substantially planar contact state. The frame 20 is constructed by stamping and forming a single metal plate into a substantially frame-like shape. An opening 24 extends in the lengthwise direction of an upper surface of the frame 20. The opening 24 serves to expose the mating recess portion 12.

The frame 20 has sidewalls 26 that are substantially rectangular in shape and have wide portions 32. Cutouts 38 are formed in the wide portion 32. The cutouts 38 are positioned by the rectangular protrusions 34 of the housing 2. Narrow portions 30 having cutouts 40 extend from ends of the wide portions 32. The cutouts 40 are formed to secure an insulating distance between the frame 20 and the tines 8*a* for a modem or the like, of which a voltage resistance property is required. The protrusions 36 are housed within the cutouts 40 of the narrow portions 30. Substantially rectangular engagement stop portions 28 extend from ends of the narrow portions 30. The engagement stop portions 28 have rectangular apertures 28*a* for engaging protrusions 33 of the housing 2, shown in FIG. 1B.

Figure 3C:
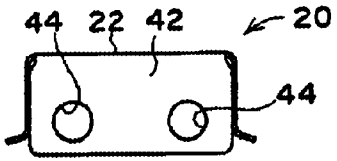
FIG. 3C is a side view.

As shown in FIG. 3C, end walls 42 extend perpendicularly downward from both ends of the upper surface 22 of the frame 20. The end walls 42 are separated from the engagement stop portions 28 and are provided with engagement stop apertures 44. The shutter member 6 is mounted on the engagement stop apertures 44.

As shown in FIG. 1, the shutter member 6 has a pair of shutter member halves 6*a*, 6*b*. As the halves 6*a*, 6*b* are substantially symmetrical, a description will be given of the first half 6*a* with reference to FIG. 4 with the understanding that the second half 6*b* is of substantially similar configuration. One portion of the halves 6*a*, 6*b* has a different configuration and will be described with letters added to the reference numerals in the description given thereof.

As shown in FIG. 4, the half 6*a* is a substantially elongated strip formed from a synthetic resin material. The half 6*a* has a main body 46 having a substantially convex surface. Arm portions 48, 49 that extend perpendicularly downward from both ends of the main body 46. A cam engagement portion or engagement piece 50*a* extends substantially perpendicular from the arm portion 48 and substantially coplanar with the main body 46. Columnar support axes 52, 54 are provided at the interior sides of the arm portions 48, 49, respectively. The support axis 52 is integrally formed with a large diameter column 53, a step portion 56, and a small diameter column 55. The main body 46 has a cutout 60 formed substantially adjacent to the arm portion 49. The cutout 60 in the first half 6*a* combines with the cutout 60 in the second half 6*b* to form a single opening 61, shown in FIG. 1A, when the halves 6*a*, 6*b* are paired together.

The mounting of the shutter member 6 will now be described. The support axes 52, 54 engage with the engagement apertures 44 at both ends of the frame 20 so that the step portion 56 abuts the frame 20. Each of the engagement pieces 50*a*, 50*b* are positioned facing each other to create a space G therebetween, shown in FIG. 1. The single opening 61 formed by the cutouts 60 is positioned substantially adjacent to the guide hole 18. Thereby, the halves 6*a*, 6*b* are mounted on the frame 20 such that the halves 6*a*, 6*b* cover the mating recess portion 12 of the mating portion 10 when lateral edges 74*a*, 74*b* converge.

When the support axes 52, 54 are mounted on the frame 20, a coil spring 62 is mounted on the support axis 52. As best shown in FIG. 1A, the coil spring 62 is integrally formed from two continuous coil portions 64. A substantially L-shaped free end portion 66 extends toward the engagement piece 50*a*, 50*b* from each coil portion 64, respectively, to urge the arms 48, 49 so that each of the halves 6*a* and 6*b* are rotatably driven towards the interior of the housing 2. The free end portion 66 is in contact with a conductor in the form of a metallic wire 68 provided at the engagement piece 50*a*.

Figures 4A, 4B, 4C, 4D, 4E:
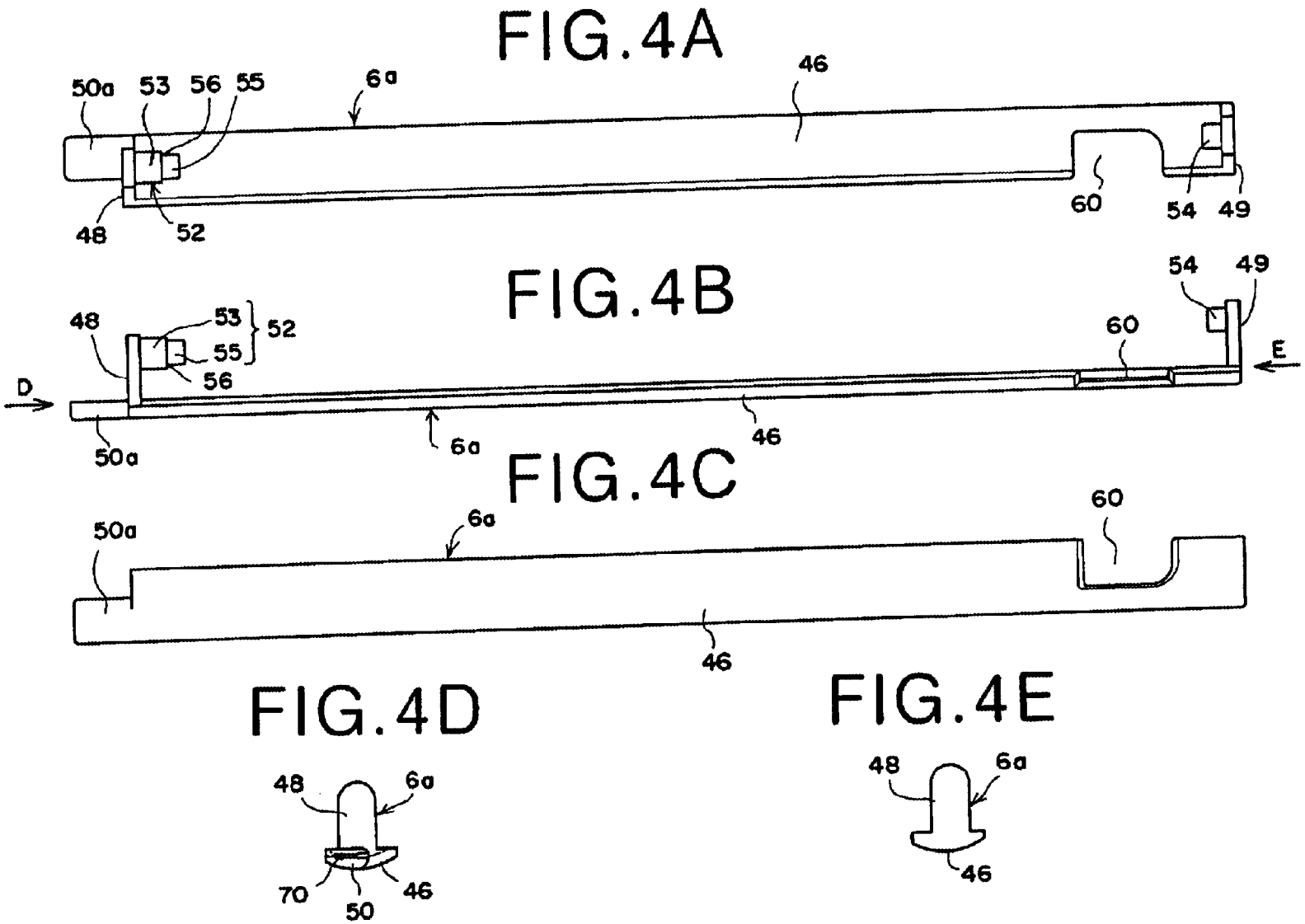
FIG. 4A is a bottom view.
FIG. 4B is a rear view.
FIG. 4C is a top view.
FIG. 4D is a side view taken from the perspective of arrow D of FIG. 4B.
FIG. 4E is a side view taken from the perspective of arrow E of FIG. 4B.

As shown in FIGS. 1 and 4D, the wire 68 is arranged within a groove 70 provided along an edge of the engagement piece 50. The wire 68 is substantially C-shaped and has an end portion 72 that extends substantially perpendicularly downward from the engagement piece 50*a*, as shown in FIG. 1B. The free end portion 66 of the coil spring 62 is positioned substantially adjacent to the end portion 72 and is arranged between the arm portions 48, 49. Thereby, the coil spring 62 and the wire 68 are electrically connected.

Figure 5A:
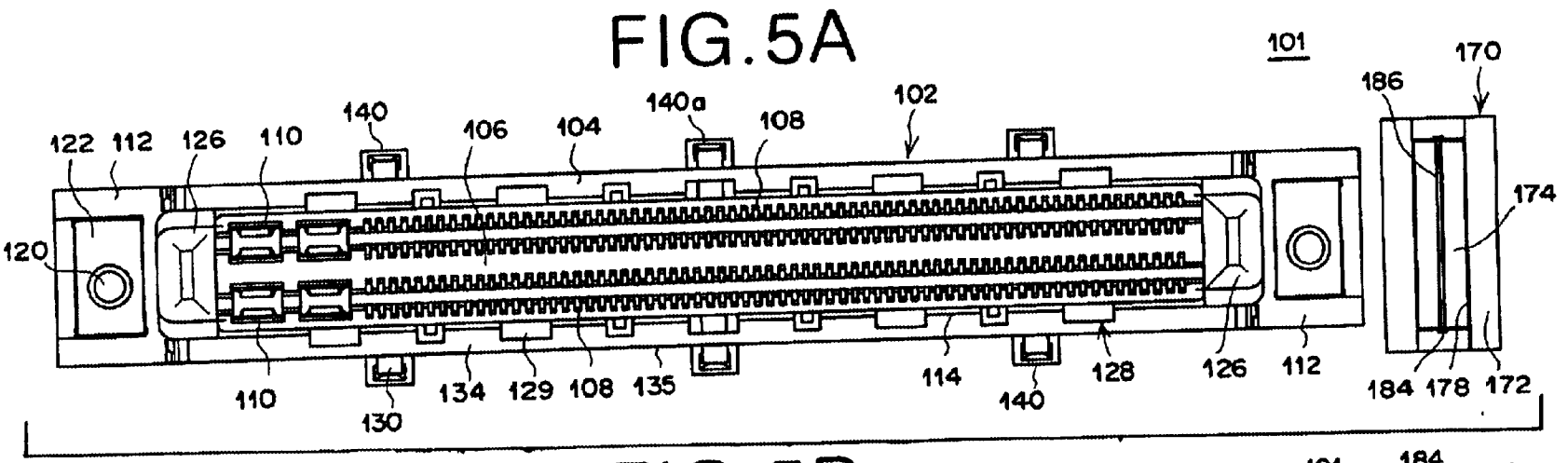
FIG. 5A is a top view.
Figure 5B:
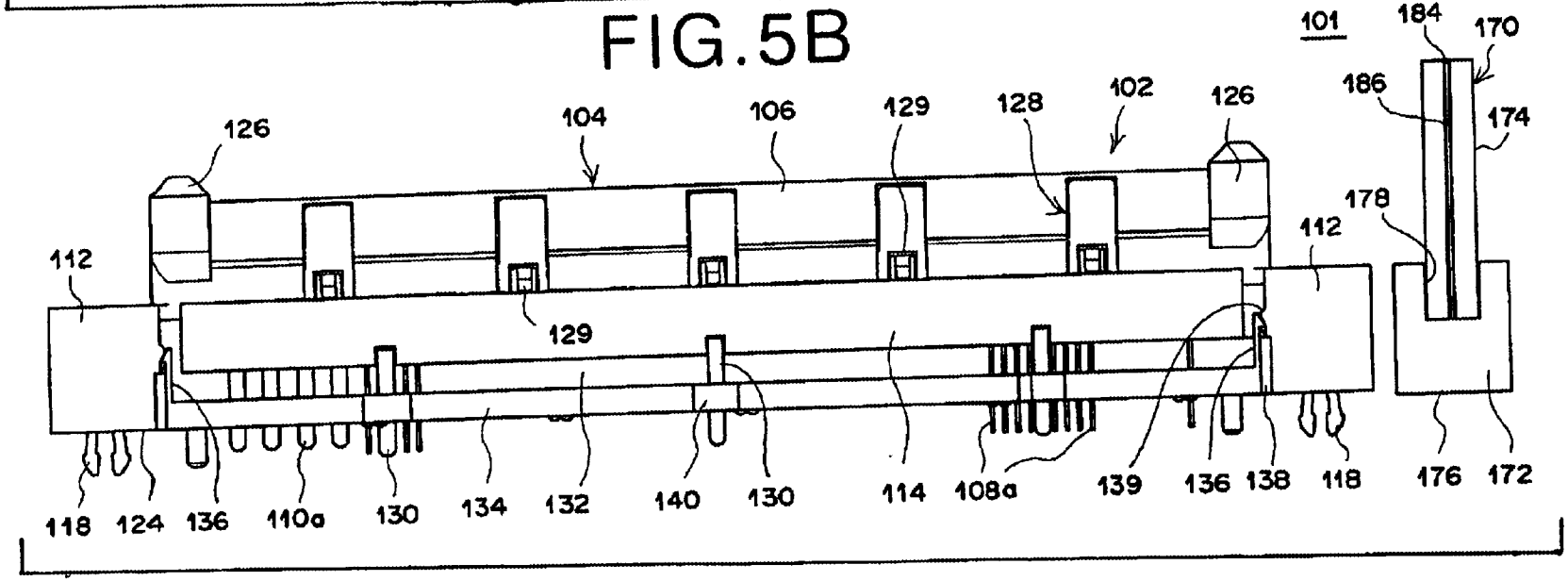
FIG. 5B is a front view.
Figure 6A:
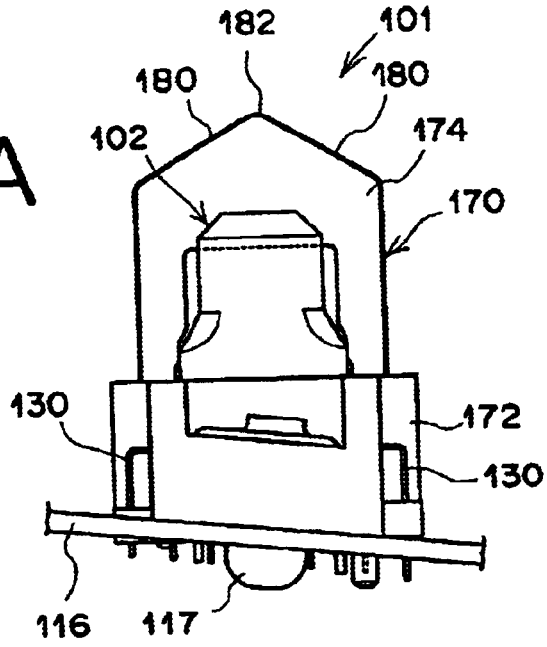
FIG. 6A is a left side view.
Figure 6B:
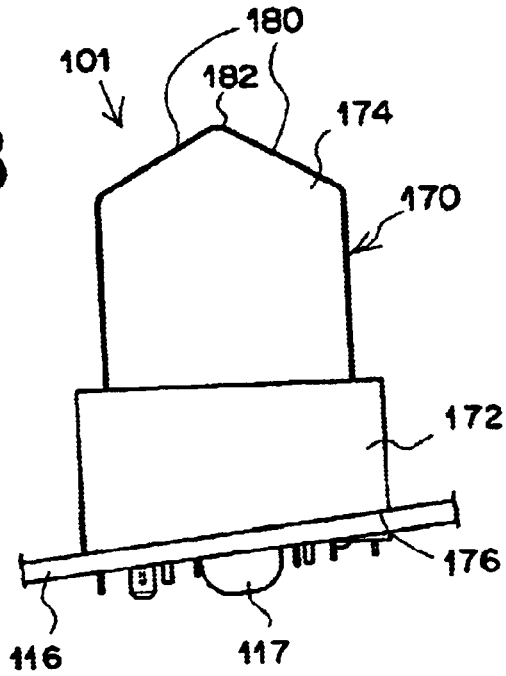
FIG. 6B is a right side view.

Shown in FIGS. 5 and 6, a connector sub-assembly 101 has a second connector 102 in the form of a plug connector and an actuator 170 arranged adjacent to an end portion of the second connector 102 in a lengthwise direction. The second connector 102 is provided with an elongate housing 104, a mating portion 106, and contacts 108, 110 that are arranged in four rows lengthwise along the mating portion 106. The contacts 108 are preferably signal contacts, and the contacts 110 are preferably wide contacts for supplying electricity. The contacts 108, 110 have tines 108*a*, 110*a*. Mounting portions 112 are positioned at both ends of the housing 104. The mounting portions 112, the mating portion 106, and a main body 114 are integrally molded from synthetic resin to form the housing 104. As shown in FIG. 5A, a metal fitting 122 having a burred threaded aperture 120 is mounted on each of the mounting portions 112. The metal fitting 122 is provided with retention legs 118 that protrude from the bottom surface of the housing 104, as shown in FIG. 5B. Shown in FIG. 6, the housing 104 is mounted on a circuit board 116 by a screw 117 and the retention legs 118 of the metal fitting 122.

As shown in FIG. 5, guide posts 126 protrude from both ends of the mating portion 106 and act as guides during engagement of the second connector 102 into the guide holes 18, 19 of the connector 1. A shield shell 128 is mounted on the interior of the main body 114. A latch arm 129 secures the shell 128 within the main body 114. Tines 130 of the shell 128 extend downward from the main body 114.

As shown in FIG. 5B, a tine plate 134 is provided in a space 132 formed between the mounting portions 112 of the housing 104. At both ends of the tine plate 134 are latch arms 136. Protrusions 138 are formed on the mounting portion 112 of the housing 104 on the side of the main body 114 adjacent to the tine plate 134. The latch arms 136 are secured by the protrusions 138 and are temporarily fixed to the housing 104 thereby. The tine plate 134 is capable of upward motion in relation to the housing 104 and, after this upward motion, the latch arms 136 are secured by protrusions 139.

AS shown in FIG. 5A, rectangular protrusion portions 140 are formed on the lateral edges 135 of the tine plate 134. The rectangular protrusion portions 140 have apertures 140*a* for receipt of the times 130. The tine plate 134 has apertures 142 for receipt of the tines 108*a*, 11*a*.

As shown in FIGS. 6, 8 and 9, the actuator 170 is mounted on the circuit board 116. The actuator 170 has a base portion 172 and a cam 174. The base portion 172 has an inclined bottom surface 176 and is mounted on the circuit board 116 in an inclined manner. The base portion 172 may be either an insulating member or a conductive member.

As shown in FIG. 5A, an upper portion of the base portion 172 is provided with a groove 178. The cam 174 is arranged within the groove 178. The cam 174 is provided with inclined surfaces 180 on both sides of a tip 182, as shown in FIG. 6. As shown in FIG. 5, a narrow groove 184 is formed substantially in the center of the outer peripheral edge of the cam 174, and a conductive wire 186 is fitted within the narrow groove 184. If the base portion 172 is constructed of an insulating material, an appropriate measure is taken to secure a conductive path that communicates with the wire 186 in order to allow the excessive voltage generated in the wire 186 to be grounded to a circuit board or to a housing. For example, a conductive path could be formed by coating the base portion 172 with a metallic material.

Figure 7A:
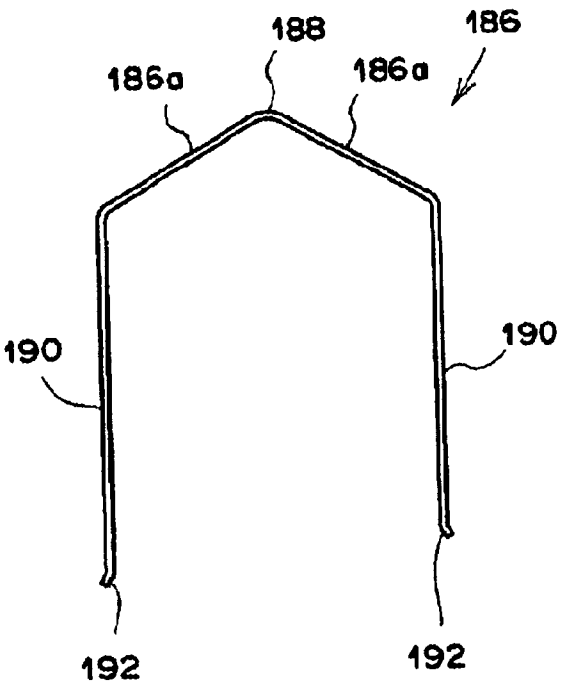
FIG. 7A is a front view.
Figure 7B:
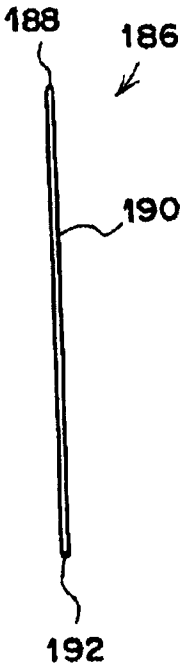
FIG. 7B is a side view.
Figure 7C:
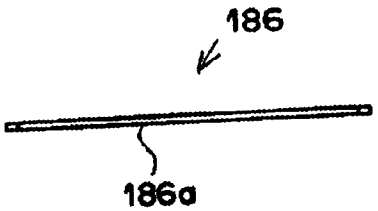
FIG. 7C is a plan view.

Shown in FIG. 7, the wire 186 has a shape substantially corresponding to the outer surface of the cam 174 and has a pair of top portions 186*a* inclined towards a tip 188. A pair of side portions 190 extend substantially parallel to each other and substantially perpendicular from the top portions 186*a*. Free ends 192 of the side portions 190 curve slightly away from each other. When the wire 186 is fitted within the narrow groove 184 of the cam 174, the free ends 192 engage the base portion 172 and are secured thereby. The wire 186 is fitted within the narrow groove 184 such that the surface of the wire 186 is exposed to the outside of the groove 184.

Figure 8A:
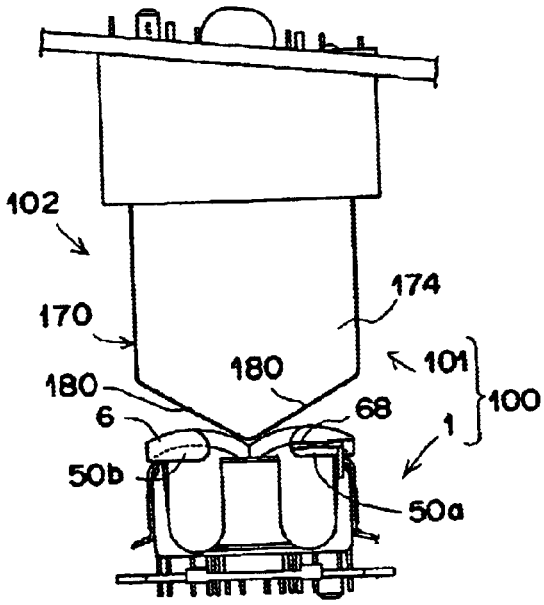
FIG. 8A is a side view showing a state just prior to contact between an actuator and the shutter member.
Figure 8B:
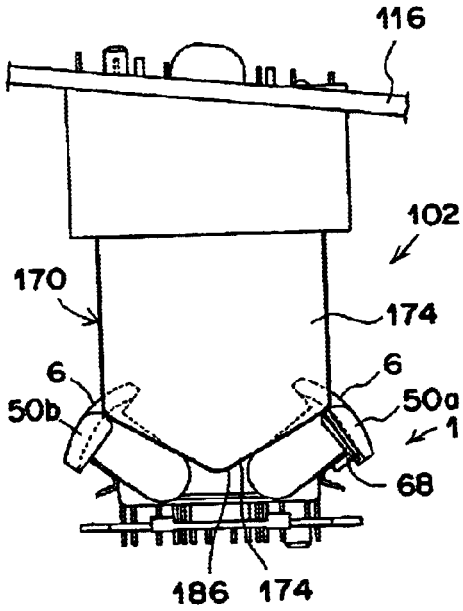
FIG. 8B is a side view showing a state in which the actuator is pushing the shutter member open, and a first conductor and a second conductor are in contact.

The connector 1 and the connector sub-assembly 101 mate to form a connector assembly 100. The method of mating the connector 1 and the connector sub-assembly 101 will now be described in greater detail with reference to FIGS. 8 and 9. As shown in FIG. 8A, the second connector 102 is positioned substantially adjacent to the connector 1 such that the tip 182 formed by the inclined surfaces 180 of the cam 174 of the actuator 170 comes into contact with the engagement pieces 50*a*, 50*b* of the shutter member 6. In this state, the housing 2 and the housing 104 are not yet in contact. Shown in FIG. 8B, as the connector 1 and the second connector 102 contact each other, the cam 174 of the actuator 170 pushes the engagement pieces 50*a*, 50*b* apart to open the shutter member to the outside and expose the mating portion 10 of the connector 1. After the cam 174 engages the engagement pieces 50*a*, 50*b* of the shutter member 6, the guide posts 126 of the second connector 102 are received in the guide holes 18, 19. If the mating engagement operation is done by hand, there are cases in which the connector 1 and the second connector 102 do not face each other squarely, but are tilted in a lengthwise direction relative to each other. In this case, the guide post 126 that corresponds to the guide hole 18 may approach the shutter member 6 before the guide post 126 that corresponds to the guide hole 19 and before the cam 174 engages the engagement pieces 50*a* and 50*b* to open the shutter member 6. In this case, however, because the shutter member 6 is provided with the opening 61, even in a state in which the shutter member 6 is not open, the guide post 126 enters the guide hole 18 without damaging the shutter member 6.

Figure 9A:
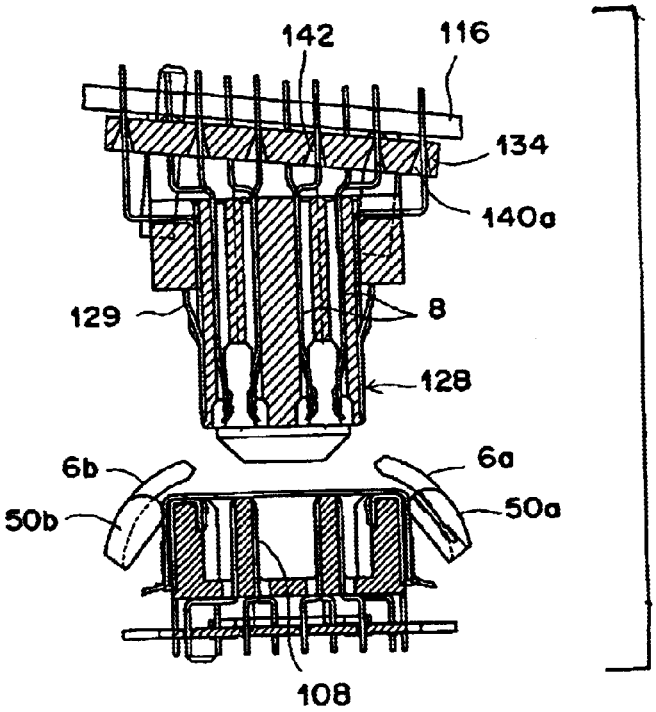
FIG. 9A is a sectional view of FIG. 8B.

At this time, the wire 68 of the shutter member 6 and the wire 186 of the cam 174 come into contact. The contact of the wires 68, 168 discharges static electricity in the connectors 1, 102. In this state, as shown in FIG. 9A, the housing 2 and the housing 104 are not yet in contact. Accordingly, the contacts 8 and the contacts 108 are not yet in contact. However, by the contact of the wire 68 and the wire 186, the discharge of static electricity at the contacts 8 and the contacts 108 is precluded.

Figure 8C:
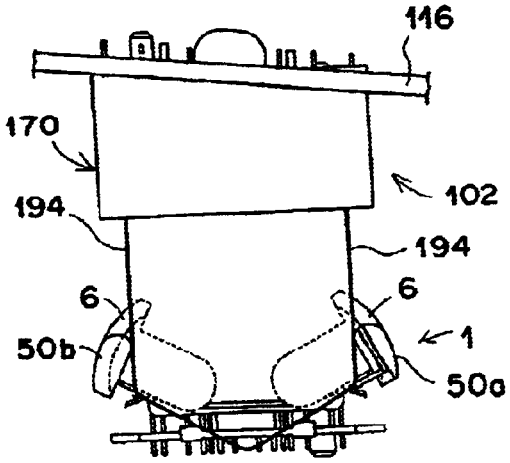
FIG. 8C is a side view showing a partial mating engagement state in which the actuator has pushed the shutter member completely open.
Figure 8D:
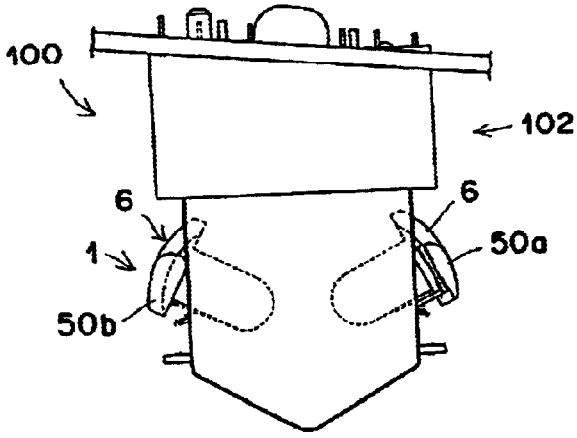
FIG. 8D shows a completed mating engagement of the connector assembly.
Figure 9B:
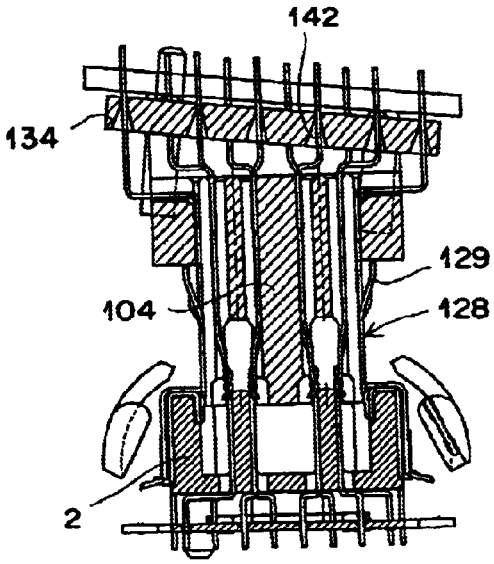
FIG. 9B is a sectional view of FIG. 8C.
Figure 9C:
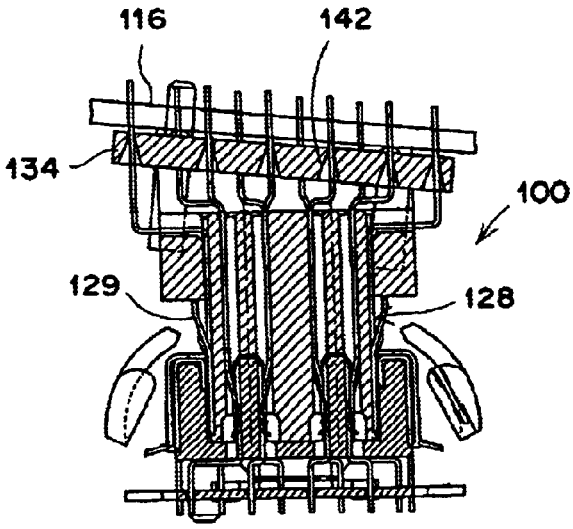
FIG. 9C is a sectional view of FIG. 8D.

Shown in FIG. 8C, as the second connector 102 is received in the connector 1 between the engagement pieces 50*a*, 50*b*, the engagement pieces 50*a*, 50*b* open as wide as the width of the lateral edges 194 of the actuator 170. At this time, mating engagement of the housing 2 and the housing 104 and contact between the contacts 8 and the contacts 108 is initiated, as shown in FIG. 9B. The assembly of the connector assembly 100 is complete when the connector sub-assembly 101 is completely received in the connector 1, as shown in FIGS. 8D and 9C.

Advantageously, the connector 1 provided with a shutter member 6 for maintaining the mating portion in a closed state to prevent foreign matter from entering and attaching to the mating portion of the connector 1. The shutter member 6 is provided with a cam engagement portion 50*a*, 50*b* to be driven by a cam 174 provided on a second connector to expose the mating portion when the connector 1 engages the second connector 102. In addition, protection of the contacts 108 from static electricity can be positively implemented, because static electricity is discharged by the conductor 68 and the conductor 186 contacting each other at an early step in the mating engagement process. Therefore, damage to electronic parts by electrostatic discharge can be prevented, in addition to the foreign matter prevention function.

Further, in the case that the shutter member is detachably mounted on a housing assembly by concave/convex engagement, an existing connector can be converted to a shuttered connector having a dust prevention function, or a dust prevention function and an electrostatic discharge prevention function.

The present invention has been described in detail above. However, it is not limited to the preferred embodiment described herein. For example, the cam 174 can be elastically mounted via a spring member, instead of being fitted into the base portion 172, so that the cam 174 is capable of expansion and compression. In addition, the actuator 170 can be mounted on the second connector 102 instead of being arranged as a separate body from the second connector 102. Further, the wire 68 can be provided not only on the engagement piece 50*a*, but additionally on the engagement piece 50*b*. Still further, the engagement pieces 50*a*, 50*b*, as well as the actuator 170, can be provided at both ends of the connector 1 and the second connector 102, respectively. The conductor 186 can be metal plated on the surface of the actuator 170, or the actuator 170 itself may be made of a metal or a conductive resin. Likewise, the conductor of the shutter member 6 can be metal plated on the surface of the halves 6*a*, 6*b*, or the halves 6*a*, 6*b* themselves may be made of a conductive resin.

We claim:

1. An electrical connector comprising:

an insulating housing having a mating portion with at least one contact;

a shutter member mounted on the insulating housing substantially adjacent to the mating portion and having a cam engagement member that drives the shutter member between an open and a closed position, the shutter member has an arm portion positioned at an end of the shutter member substantially adjacent to the cam engagement member, the arm portion extends substantially perpendicular from the shutter member and is provided with a spring that drives the shutter member between an open and closed position when the cam engagement member is contacted by a second connector; and a conductor provided on the shutter member that contacts the second connector to prevent electrostatic discharge, the conductor is provided on the cam engagement member of the shutter member.

2. The electrical connector of claim 1, wherein the shutter member is detachably mounted on the insulating housing.

3. The electrical connector of claim 1, wherein the shutter member has a first shutter member half and a second shutter member half that converge in the closed position.

4. The electrical connector of claim 3, wherein the first and second shutter member halves are substantially convex in shape.

5. The electrical connector of claim 1, wherein the conductor is electrically connected to the spring.

6. The electrical connector of claim 1, wherein the shutter member is provided with a cutout for receiving a guide member of the second connector.

7. The electrical connector of claim 1, wherein the conductor is electrically connected to a metallic shield shell provided on the insulating housing.

8. An electrical connector assembly comprising:

a first connector having a mating portion and a shutter member mounted substantially adjacent to the mating portion;

a first conductor provided on the shutter member;

a cam engagement member that drives the shutter member between an open and a closed position;

a second connector having an actuator with a cam; and a second conductor provided on the cam that contacts the first conductor to prevent electrostatic discharge when the cam engages the cam engagement member to drive the shutter member into an open position, the second conductor is a conductive wire that is fitted in a groove provided on the cam and the first conductor is provided on the cam engagement member of the shutter member.

9. The electrical connector assembly of claim 8, wherein the cam has a first and second inclined surface that converge at a tip that engages the cam engagement member.

10. The electrical connector assembly of claim 8, wherein the conductive wire has a first end and a second end that secure the wire on the actuator.

11. An electrical connector comprising:

a connector having an actuator with a cam; and a conductive wire that is fitted in a groove provided on the cam, the conductive wire positioned to contact a conductor on a mating connector when the cam engages a cam engagement member on the mating connector.

12. The electrical connector of claim 11, wherein the cam has a first and second inclined surface that converge at a tip that engages the cam engagement member.

13. The electrical connector of claim 11, wherein the conductive wire has a first end and a second end that secure the wire on the actuator.

* * * * *